US006070512A

United States Patent [19]

Rohrbaugh

[11] Patent Number: 6,070,512

[45] Date of Patent: Jun. 6, 2000

[54] HANDGUN AND METHOD OF OPERATING HANDGUN

[76] Inventor: Karl Rohrbaugh, 24 Namkee La., Blue Point, N.Y. 11715

[21] Appl. No.: 09/134,082

[22] Filed: Aug. 14, 1998

[51] Int. Cl.[7] ..... F41A 19/38

[52] U.S. Cl. ..... 89/147; 89/27.14; 42/69.02; 42/70.06; 42/70.07; 42/70.08

[58] Field of Search ..... 42/69.02, 6, 69.01, 42/70.08, 70.06, 70.07; 89/27.11, 27.14, 147

[56] References Cited

U.S. PATENT DOCUMENTS

| | | | |
|---|---|---|---|
| 990,475 | 4/1911 | Cuccurullo | 89/147 |
| 1,423,836 | 7/1922 | Declaye | 42/69.02 |
| 1,693,530 | 11/1928 | Spencer | 42/16 |
| 4,930,239 | 6/1990 | Hunter | 89/194 |
| 5,086,579 | 2/1992 | Flatley et al. | 42/70.08 |
| 5,179,233 | 1/1993 | du Plessis | 42/69.02 |
| 5,355,768 | 10/1994 | Felk | 89/147 |
| 5,570,527 | 11/1996 | Felicci | 42/70.08 |
| 5,678,342 | 10/1997 | Felk | 42/70.07 |

FOREIGN PATENT DOCUMENTS

| | | | |
|---|---|---|---|
| 10492 | 7/1909 | France | 42/69.02 |
| 663853 | 8/1929 | France | 42/69.02 |

*Primary Examiner*—Stephen M. Johnson
*Attorney, Agent, or Firm*—Adams & Wilks

[57] ABSTRACT

A handgun comprises a frame, a trigger mounted on the frame for movement between a rest position and a depressed position, a firing pin movable along a firing path between a cocked condition remote from a cartridge chamber and a fire condition proximate the cartridge chamber for firing a cartridge, and a biasing member for biasing the firing pin toward the fire condition. A transmission member is disposed between the trigger and the firing pin, via the firing path, and is responsive to depression of the trigger to displace the firing pin against the bias of the biasing member toward the cocked condition. A deflecting element deflects the transmission member out of the firing path of the firing pin to release the firing pin from the cocked condition and allow the firing pin to be propelled by the biasing member to the fire condition to fire the cartridge.

43 Claims, 11 Drawing Sheets

HANDGUN AND METHOD OF OPERATING HANDGUN

BACKGROUND OF THE INVENTION

1. Field of the Invention

The present invention relates generally to firearms and, more particularly, to a handgun and a method of operating a handgun.

2. Background of the Invention

The design of firearms in recent years, and in particular handguns, has required the use of fewer moving parts to thereby make the handgun more reliable. With fewer moving parts in handguns, the cost of manufacture is significantly reduced, assembly/disassembly and maintenance are greatly simplified, and there is less chance of failure of such parts, resulting in an optimum design for the handgun characterized with high reliability and efficacy. In addition to improving the reliability and efficacy of handguns, the use of fewer moving parts results in a handgun which is light and compact, leading to more comfortable usage of the handgun and to the ability of concealing the handgun for self-defense purposes.

In conventional handguns, however, since the number of moving parts is not sufficiently reduced to a minimum, there is no significant reduction in the cost of manufacture, weight and degree of compactness of the handgun. Furthermore, assembly/disassembly and maintenance of conventional handguns is complex, and the interaction of the components thereof lacks reliability and simplicity. Still further, the manufacture of conventional handguns is complex and expensive since such guns require the use of specialty tooling for the fabrication of the components thereof.

There is also a well-recognized need to prevent the undesired firing of a handgun. For example, it would be useful to incorporate in a handgun a safety mechanism which would efficiently prevent accidental firing or any unauthorized use of the handgun. Conventional safety mechanisms for handguns, however, are complex in construction and operation and add additional components which substantially increase the overall weight of the handgun.

The present invention overcomes many of the disadvantages inherent in the manufacture, assembly/disassembly, use and maintenance of conventional handguns.

SUMMARY OF THE INVENTION

It is an object of the present invention is to provide a handgun of light weight, compact and economical construction which facilitates manufacture.

It is another object of the present invention to provide a handgun in which specialty tooling for the manufacture thereof is kept to a minimum.

It is another object of the present invention to provide a handgun in which the number of moving components is reduced to a minimum and the interaction of these components is reliable and simple.

It is another object of the present invention to provide a handgun having a double-action trigger and firing assembly which allows for a smoother, simpler and more consistent trigger action providing improved firing accuracy.

It is another object of the present invention to provide a handgun having constructional features which provide for improved assembly and disassembly of the components thereof.

It is another object of the present invention to provide a handgun having a safety mechanism which is simple in construction and which can reliably inhibit unauthorized operation of the handgun.

It is still another object of the present invention to provide a method of operating a handgun by smooth, consistent trigger action providing improved accuracy.

The foregoing and other objects of the present invention are carried out by a handgun comprising a frame, a trigger mounted on the frame for movement between a rest position and a depressed position, a firing pin movable along a firing path between a cocked condition remote from a cartridge chamber and a fire condition proximate the cartridge chamber for firing a cartridge, a biasing member for biasing the firing pin toward the fire condition, a transmission member operatively disposed between the trigger and the firing pin, via the firing path, and being responsive to depression of the trigger to displace the firing pin against the bias of the biasing member toward the cocked condition, and deflecting means for deflecting the transmission member out of the firing path of the firing pin to release the firing pin from the cocked condition and allow the firing pin to be propelled by the biasing member to the fire condition to fire the cartridge.

A pivot member is mounted on the frame for pivotal movement between a first position and a second position. The pivot member has a first limb for operative engagement with the firing pin in the first position of the pivot member and a second limb for operative engagement with the transmission member in the second position of the pivot member. The transmission member has an engagement element for operative engagement with the second limb of the pivot member in response to depression of the trigger to pivot the pivot member from the first position to the second position thereof to deflect the second limb of the pivot member from operative engagement with the firing pin.

A resetting surface is slidingly displaceable relative to the transmission member for contacting and moving the transmission member to disengage the engagement element of the transmission member from the second limb of the pivot member and thereby allow the pivot member to pivot to the first position.

In another embodiment, the handgun according to the present invention further comprises means for inhibiting depression of the trigger to thereby prevent the movement of the firing pin to the cocked condition and the subsequent release of the firing pin to the fire condition to fire the cartridge.

In another aspect, the present invention is directed to a method of operating a handgun. The method comprises the step of providing a handgun having a frame, a trigger mounted on the frame for movement between a rest position and a depressed position, a firing pin movable along a firing path between a cocked condition remote from a cartridge chamber and a fire condition proximate the cartridge chamber for firing a cartridge, a biasing member for biasing the firing pin toward the fire condition, a transmission member operatively disposed between the trigger and the firing pin, via the firing path, for transmitting the motion of the trigger to the firing pin, and a deflecting element fixed to the frame for deflecting the transmission member out of the firing path of the firing pin. The method further comprises the steps of transmitting the motion of the trigger, when being depressed, to the firing pin by displacing the transmission member to displace the firing pin to the cocked condition against the bias of the biasing member, and deflecting the transmission member out of the firing path of the firing pin, in response to continued displacement of the transmission member, by means of the displacement element to release the firing pin from the cocked condition and allow the firing pin to be propelled by the biasing member to the fire condition to fire the cartridge.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
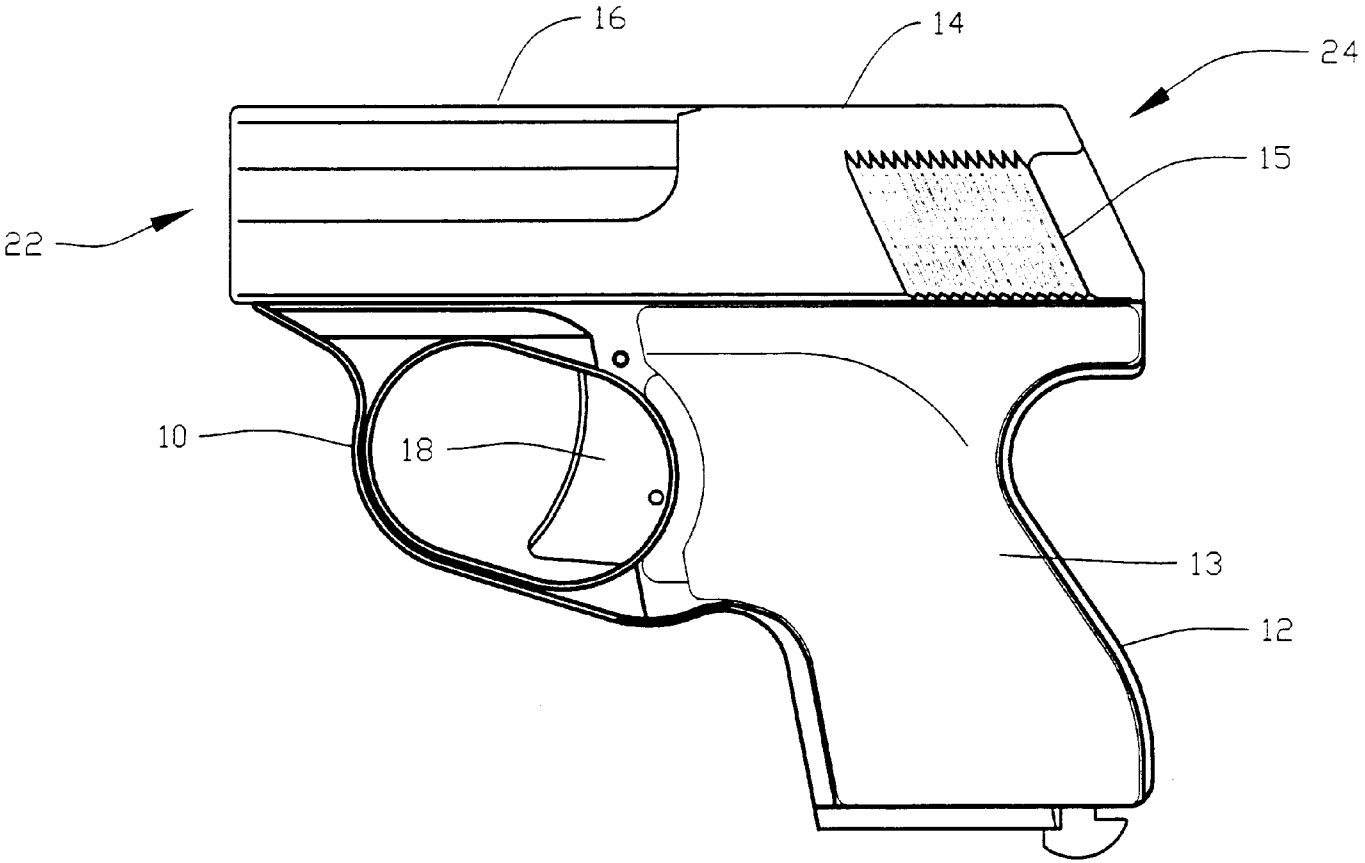
FIG. 1 is a view in side elevation of a handgun according to an embodiment of the present invention.
Figure 2:
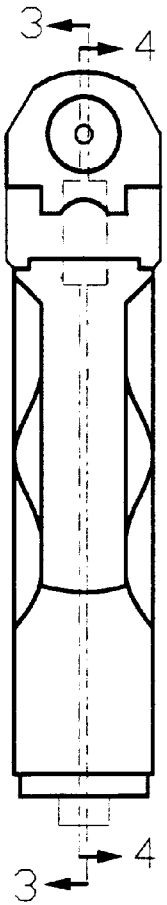
FIG. 2 is a view in front elevation of the handgun according to the present invention.

While this invention is susceptible of embodiments in many different forms, this specification and the accompanying drawings disclose only preferred embodiments of the invention. The invention is not intended to be limited to the embodiments so described, and the scope of the invention will be pointed out in the appended claims.

Although the preferred embodiments of the invention are described in connection with small semi-automatic firearms, such as semi-automatic handguns, the invention described herein has utility in other types of firearm, as well. Therefore, all aspects of the present invention should not only be considered as extending to the type of firearm illustrated, but also to other types of firearms.

Certain terminology is used in the following description for convenience only and is not intended to be limiting. The words right, left, front, rear, upper, lower, inner, outer, rearwardly and forwardly designate directions in the drawing to which reference is made. Such terminology includes the words above specifically mentioned and words of similar import.

Referring now to the drawings in detail, wherein like numerals are used to indicate like elements throughout, there is shown in FIGS. 1–21 an embodiment of a handgun according to the present invention which generally comprises a frame 10, a hand grip 12 of ergonomic configuration integral with the frame 10, a slide 14 slidably mounted on the frame 10, a barrel 16 mounted to the frame 10, a trigger 18 and a firing mechanism indicated generally by 20.

The frame 10 is generally hollow and has a forward end 22, a rear end 24, a top 26 (FIG. 5), a first locating recess 28 disposed above the trigger 18 and generally between the forward end 22 and the rear end 24, and a second locating recess 30 at the rear end 24. The hand grip 12 is located at the rear end 24 of the frame 10. A trigger guard 32 integral with the frame 10 and the hand grip 12 guards the trigger 18.

The barrel 16 is disposed on the top 26 of the frame 10 and has a bore 34 having an open end, a cartridge chamber 36 coaxial with the bore 16 for sequentially receiving live rounds or cartridges 38 to be fired, and a support portion 40 for connecting the barrel 16 to the frame 10. The support portion 40 has an inclined surface 40*a* defining a feed ramp for feeding the live cartridges from a magazine assembly, generally designated at 42, to the cartridge chamber 36. The first locating recess 28 of the frame 10 receives and properly positions the barrel support portion 40. The barrel support portion 40 is mounted to the frame 10 by a connecting pin 44 extending through a hole 40*b* formed in the barrel support portion 40 and corresponding aligned holes (not shown) formed in the frame 10 and retained therein with a friction fit.

The bore 34 of the barrel 16 has a central axis A, a rifled bore portion 16*a* and a free bore portion 16*b*. The rifled bore portion 16*a* extends from the open end of the bore 16 toward the cartridge chamber 36. The free bore portion 16*b* is disposed between the rifled bore portion 16*a* and the cartridge chamber 36. In the present embodiment, the rifled bore portion 16*a* defines approximately 75% of the bore 16, with the remaining portion of the bore 16 being defined by the free bore 16*b*. During a firing sequence, the free bore 16*b* allows the cartridge 38 to build momentum with less resistance at the time when the pressure of the gas in the cartridge chamber 36 is highest, allowing the gas to expand toward the forward end 22 of the frame 10, thereby decreasing the pressure applied against the slide 14. By this construction, since the pressure applied against the slide 14 during a firing sequence is reduced, the slide 14 can be made smaller and lighter, thereby allowing reduction in both the size and weight of the handgun.

Referring now to FIGS. 1 and 5–7, the slide 14 comprises an elongate cover having forward and rear portions removably mounted over the top 26 of the frame 10. The slide 14 is slidably mounted on the frame 10 for reciprocal longitudinal movement between first and second positions. The first position of the slide 14 corresponds to a firing position wherein the handgun is capable of firing, which thereby drives the slide to the second position wherein a spent blank cartridge is ejected. The slide 14 is preferably slidably mounted on the frame 10 in tongue-and-groove fashion, where the slide 14 is provided with depending flange portions 46 having longitudinal recesses 47 to slidably receive guide lugs 48 on side edges of the frame 10. The slide 14 is provided with serrations 15, as shown in FIG. 1, to facilitate manipulation of the slide 14 by a user during operation of the handgun.

Figure 3:
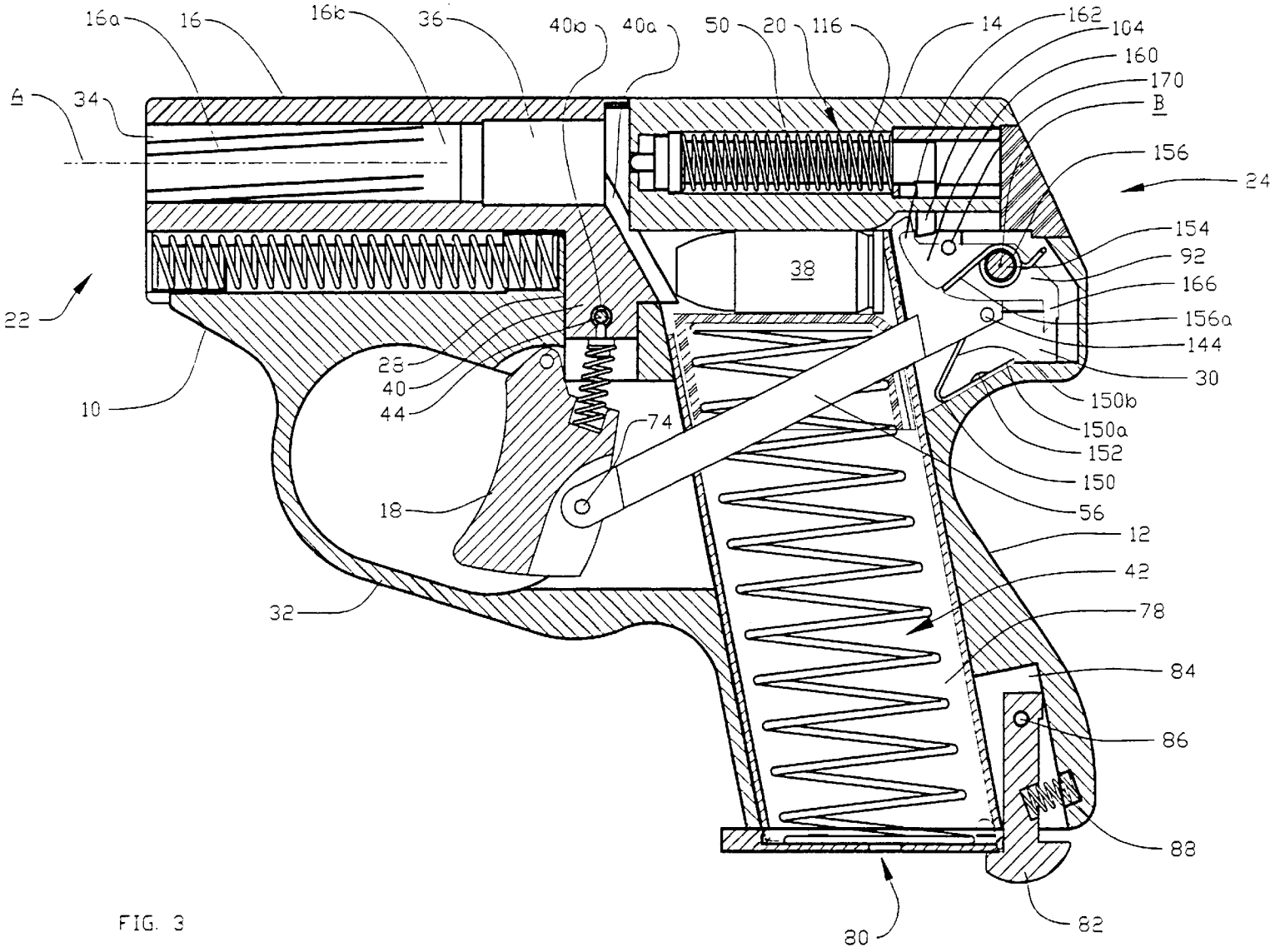
FIG. 3 is a right side longitudinal sectional view taken substantially on the line 3—3 of FIG. 2.
Figure 4:
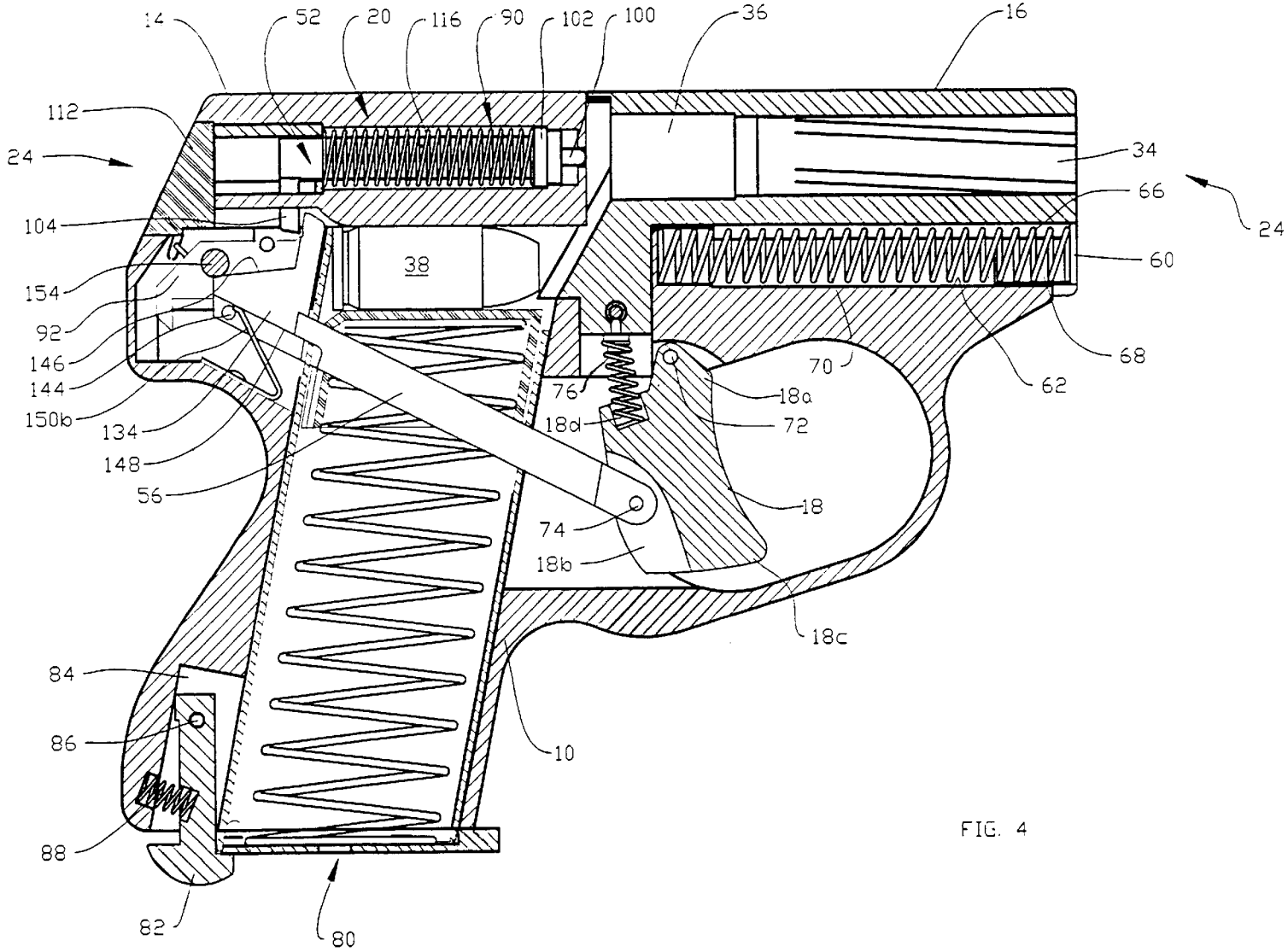
FIG. 4 is a left side longitudinal sectional view taken substantially on the line 4—4 of FIG. 2.
Figure 5:
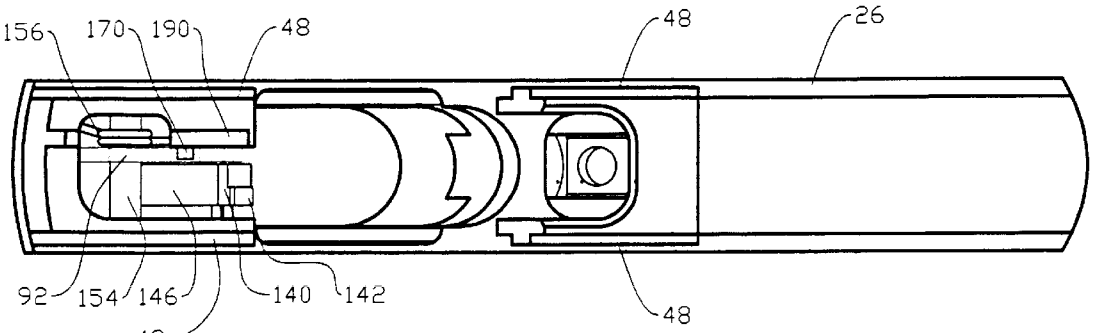
FIG. 5 is a top view of the handgun according to the present invention with the barrel and the slide removed.
Figure 6:
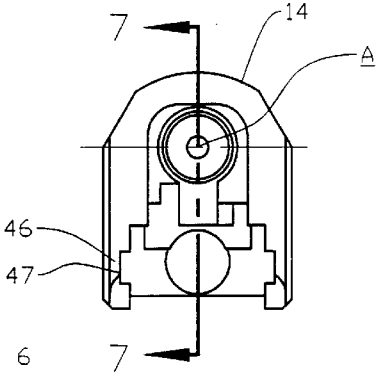
FIG. 6 is a rear view of the slide of the handgun according to the present invention.

The rear portion of the slide 14 has an elongate passage, generally designated 50, for receiving a firing pin assembly, generally designated 52 in FIG. 4, of the firing mechanism 20. The rear portion of the slide 14 is also provided with a resetting surface 54 (FIG. 7) for operatively abutting a transmission member 56 of the firing mechanism 20. The forward portion of the slide 14 has walls 58, 59, 60 which, together with walls 62, 64 of the frame 10 and a wall 66 of the barrel 16, as shown in FIG. 1, define a chamber 68 for housing a recoil spring 70. By this construction, the recoil spring 70 is operatively connected to the slide 14 for returning the slide 14 to the first position thereof. When the slide 14 is mounted on the top 26 of the frame 10 in the assembled condition of the handgun, as shown in FIGS. 3 and 4, the elongate passage 50 is coaxial with the cartridge chamber 36 and the bore 34 of the barrel 16 along the central axis A.

Figure 7:
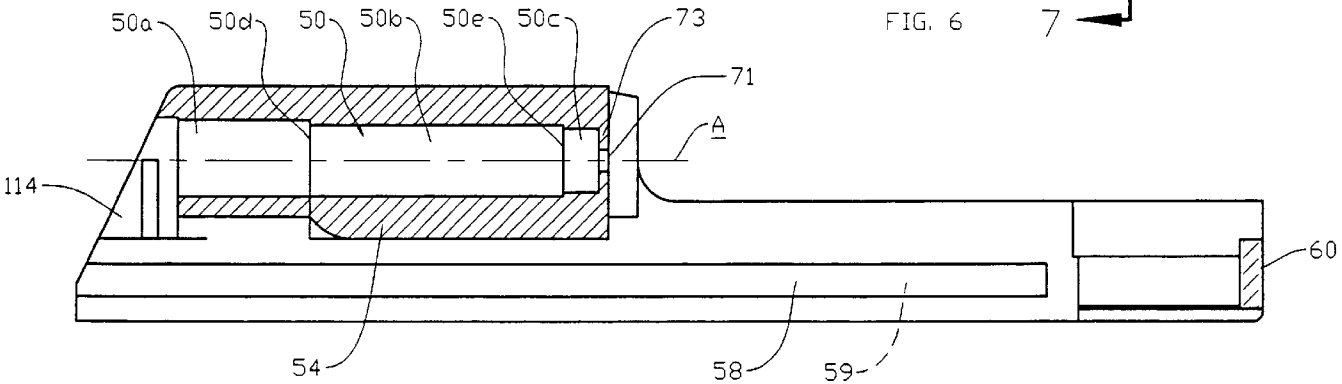
FIG. 7 is a view in longitudinal section taken substantially on the line 7—7 of FIG. 6.

As shown in FIG. 7, the elongate passage 50 has passage sections of decreasing diameter extending from the rear end to the forward end of the slide 14. More specifically, the elongate passage 50 has a first passage section 50*a* having a first diameter, a second passage section 50*b* having a second diameter smaller than the first diameter, and a third passage section 50*c* having a third diameter smaller than the second diameter. The slide has a first shoulder 50*d* disposed between the first and second passage sections 50*a*, 50*b* and a second shoulder 50*e* disposed between the second and third passage sections 50*b*, 50*c*. An opening 71 extends through a wall 73 of the slide 14 adjacent to the third passage section 50*c* and is coaxial with the firing pin assembly 52, the cartridge chamber 36 and the bore 34 of the barrel 16. The opening 71 has a diameter sufficient to allow passage therethrough of a firing pin of the firing pin assembly 52 for striking the primer of the live cartridge 38 disposed in the cartridge chamber 36.

Referring back to FIGS. 3 and 4, the trigger 18 projects outwardly from the frame 10 into a space defined by the trigger guard 32 and is pivotally connected to the frame 10 by means of a connecting pin 72 passing through an upper end 18*a* of the trigger 18 and through associated apertures in the frame 10. The trigger 18 is also pivotally connected to the firing mechanism 20 via the transmission member 56 by means of a connecting pin 74 at a side portion 18*b* of the trigger 18 intermediate the connecting pin 72 and a free end 18*c* of the trigger 18. The trigger 18 is movable between a forward, rest position and a rearward, depressed position, and the trigger is biased by a biasing member, such as a compression spring 76, toward the rest position. The spring 76 has a first end disposed and supported within a recess 18*d* formed at a top portion of the trigger 18, and a second opposite end supported by the support portion 40 of the barrel 16.

The hand grip 12 is disposed at the rear end 24 of the frame 10 and is provided with a cover 13 (FIG. 1) which provides a grip to facilitate manipulation by the user. The hand grip 12 is hollow to define a magazine well 78 to accommodate the magazine assembly 42, which is a standard magazine for sequentially feeding the live cartridges 38, by spring loading, via the feed ramp 40*a* into the cartridge chamber 36. The magazine well 78 opens to the exterior via an opening, generally designated at 80, which is disposed at a free end of the hand grip 12. A magazine catch 82 is mounted in a passage 84 of the hand grip 12 and is pivotally connected to the hand grip 12 by means of a connecting pin 86. A biasing member, such as a compression spring 88, biases the magazine catch 82 so that the magazine catch 82 extends across part of the opening 80 for retaining the magazine assembly 42 in the magazine well 78. By this construction, a user can easily manually urge the magazine catch 82 clear of the opening 80 against the bias of the spring 88 to enable the magazine assembly 42 to be inserted into or withdrawn from the magazine well 78.

The frame 10, the slide 14, the barrel 16 and the trigger 18 are preferably formed of stainless steel, such as 416R stainless steel. However, it is understood by those skilled in the art that these components may be formed of other materials exhibiting a high ratio of strength to weight. For example, aluminum, titanium, ceramic, polymer (e.g., high impact fiber reinforced polymer), a metal matrix, carbon fibers or composite materials are also suitable materials for some or all of the frame 10, the slide 14, the barrel 16 and the trigger 18.

The firing mechanism 20 of the handgun according to the present invention will now be described with reference to FIGS. 3–18. The firing mechanism 20 comprises broadly the firing pin assembly 52 movable during a firing sequence between a rearward, cocked condition, remote from the cartridge chamber 36, and a forward, fire condition, proximate the cartridge chamber 36, resilient biasing means indicated generally by 90 for biasing the firing pin assembly 52 to its fire condition, the transmission member 56 for transmitting movement of the trigger 18 to the firing pin assembly 52, and a pivot member 92.

In the assembled condition of the handgun, as shown in FIGS. 3–4, the firing pin assembly 52 is movably mounted to the slide 14 within the elongate passage 50 and is coaxial with the cartridge chamber 36 and the bore 34 of the barrel 16 along the central axis A.

Figure 8:
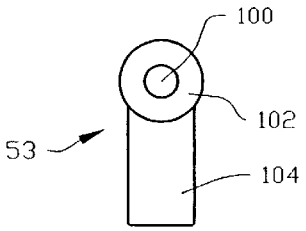
FIG. 8 is a front view of a firing pin of a firing pin assembly according to the present invention.
Figure 9:
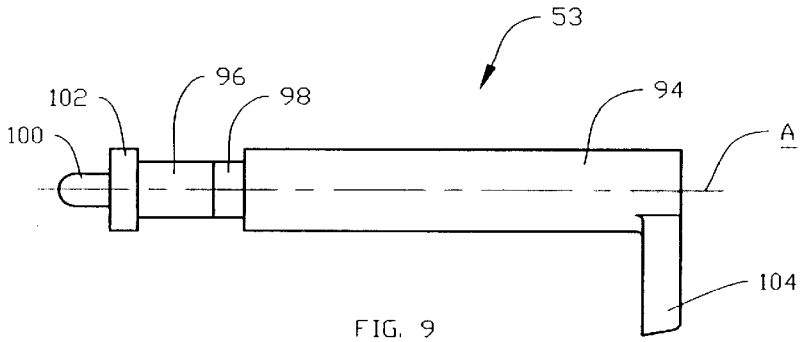
FIG. 9 is a side view of the firing pin shown in FIG. 8.
Figure 10:
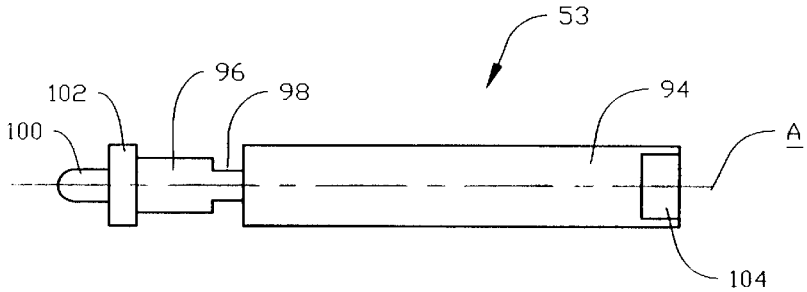
FIG. 10 is a side view of the firing pin shown in FIG. 9 rotated at 90 degrees.

As best shown in FIGS. 8–10, the firing pin assembly 52 comprises a firing pin 53, a first guide member 106 and a second guide member 108. The firing pin 53 has a first cylindrical body portion 94 for movement within the first and second passage sections 50*a,* 50*b* of the slide elongate passage 50, a second cylindrical body portion 96 for movement within the second and third passage sections 50*b,* 50*c* of the slide elongate passage 50, a reduced diameter portion 98 disposed between the first and second cylindrical body portions 94, 96, a pin 100 disposed at a first end of the firing pin assembly 52, a guiding portion 102 disposed between the second cylindrical body portion 96 and the pin 100, and an abutment portion 104 integrally connected to and extending outwardly from the first cylindrical body portion 94 at a second end of the firing pin assembly 52. The pin 100 is dimensioned to pass through the opening 71 of the slide elongate passage 50 during the firing condition of the firing mechanism 20 for striking the primer of the live cartridge 38 disposed in the cartridge chamber 36. The abutment portion 104 defines a firing pin sear for movement along a firing path generally parallel to the central axis A of the barrel bore 34 during a firing sequence, and the abutment portion 104 is arranged to operatively abut the transmission member 56 and the pivot member 92 of the firing mechanism 20 as further described below.

Preferably, the abutment portion 104 comprises a separate element connected to the first cylindrical body portion 94 by suitable connecting means, such as hardware and/or welding. However, it is understood by those skilled in the art that the entire firing pin 53 may be formed as a unitary, one-piece structure from a single piece of material by a suitable manufacturing process.

A rear end of the first cylindrical body portion 94 of the firing pin 53 is guided by the first guide member 106 for movement within the first passage section 50*a* of the slide elongate passage 50 during a firing sequence. As shown in FIGS. 3–4 and 11–12, the first guide member 106 comprises a generally cylindrical-shaped sleeve frictionally fitted within the first passage section 50*a* and engaging the first shoulder 50*d* of the slide elongate passage 50. A lower surface of the first guide member 106 is provided with a slot 110 for permitting the abutment portion 104 of the firing pin assembly to extend through the slot 110 and into the second locating recess 30 at the sear end 24 of the frame 10, thereby permitting movement of the first cylindrical body portion 94 within the first passage section 50*a* during a firing sequence. A cover plate 112 is releasably located in an open end 114 of the slide elongate passage 50 at the rear end of the frame 10 for retaining the first guide member 106 within the first passage section 50*a*.

Figure 13:
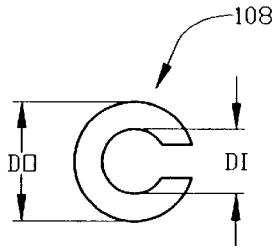
FIG. 13 is a view in side elevation of a retainer of the firing pin assembly according to the present invention.
Figure 11:
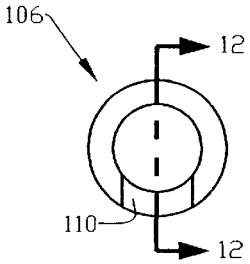
FIG. 11 is a front view of a sleeve of the firing pin assembly according to the present invention.
Figure 12:
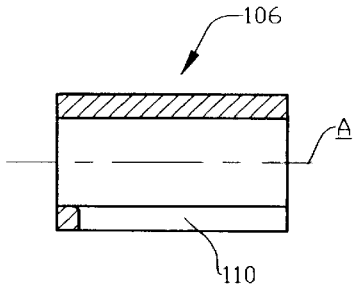
FIG. 12 is a view in longitudinal section taken substantially on the line 12—12 of FIG. 11.

A forward end of the first cylindrical body portion 94, the second cylindrical body portion 96, the reduced diameter portion 98, the pin 100 and the guide portion 102 are guided for movement within the second passage section 50*b* of the slide elongate passage 50 by the second guide member 108. As shown in FIGS. 3–4 and 13, the second guide member 108 is generally C-shaped in configuration and is disposed between the first cylindrical body portion 94 and the guiding portion 102. The second guide member 108 has an outer diameter DO selected so that a clearance is provided between an inner circumferential surface of the second passage section 50*b* and an outer circumferential surface of the second guide member 108 to permit movement of the firing pin 53 to the fire condition during a firing sequence while allowing the second guide member 108, together with the guiding portion 102 and the first guide member 106, to be maintained in coaxial relation along the central axis A with the opening 71 of the slide elongate passage 50, the cartridge chamber 36 and the barrel bore 34. The second guide member 108 has an inner diameter DI selected to allow free passage therethrough of the second cylindrical body portion 96 and the reduced diameter portion 98 during a firing sequence. As shown in FIG. 4, the outer diameter DO of the second guide member 108 is greater than the inner diameter of the third passage section 50*c*. By this construction, movement of the second guide member 108 in the direction toward the forward end of the frame 10 is limited by the second shoulder 50*e* of the slide elongate passage 50.

Referring again to FIG. 4, the resilient biasing means 90 comprises a long action firing spring 116 disposed over the first cylindrical body portion 94, the second cylindrical body portion 96 and the reduced diameter portion 98 and arranged to be placed under compression to propel the firing pin 53 towards the firing condition with a relatively strong, predetermined force. The firing spring 116 is anchored, at opposite ends thereof, between the first guiding member 106 and the second guiding member 108.

Figure 16:
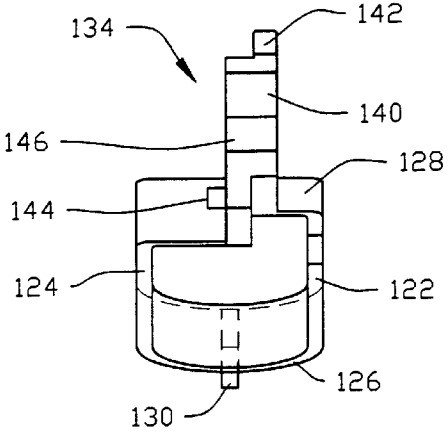
FIG. 16 is a front view of the transmission member shown in FIG. 14.
Figure 14:
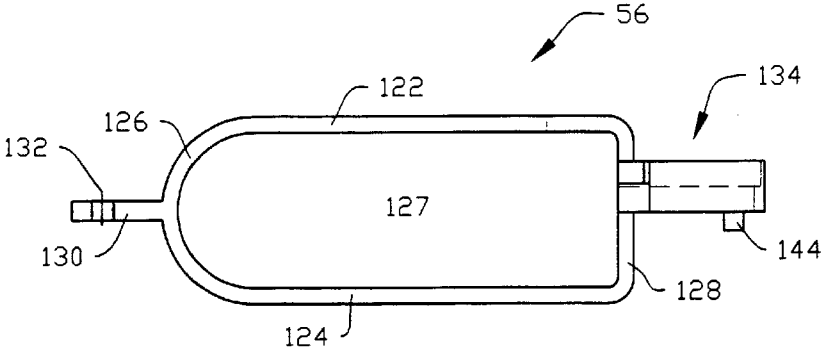
FIG. 14 is a top view of a transmission member of the firing mechanism according to the present invention.
Figure 15:
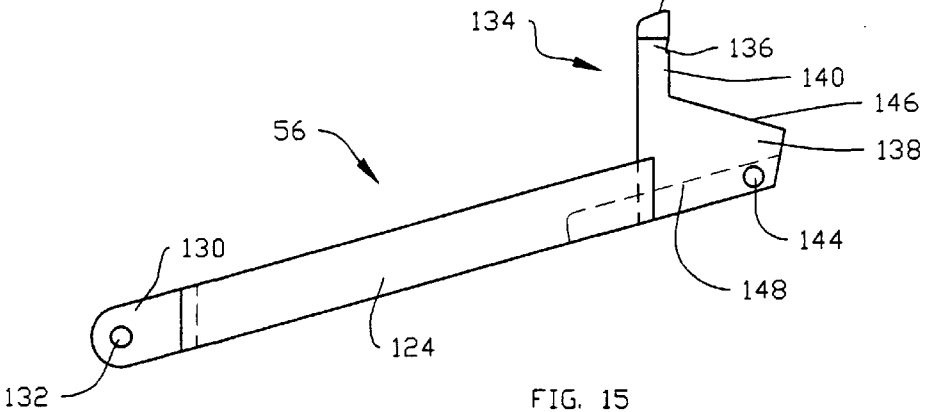
FIG. 15 is a side view of the transmission member shown in FIG. 14.

Referring to FIGS. 14–16, the transmission member 56 has a generally U-shaped frame portion having a pair of spaced-apart leg portions 122, 124 and a curved portion 126 defining a through opening 127. An interconnecting web portion 128 integrally connects the leg portions 122, 124 at ends thereof opposite the curved portion 126. An ear portion 130 is integrally connected to and extends from the curved portion 126 for pivotal connection to the side portion 18*b* of the trigger 18 and has a hole 132 through which the connecting pin 74 extends. A sear, generally designated at 134, is integrally connected to and extends from the interconnecting web portion 128 for operatively abutting the abutment portion 104 of the firing pin 53.

The sear 134 has a generally V-shaped configuration having a first leg portion 136 and a second leg portion 138. The first leg portion 136 of the sear 134 has an edge 140 for operatively abutting the abutment portion 104 of the firing pin 53 and a bumper surface 142 for operatively abutting the resetting surface 54 of the slide 14. The second leg portion 138 of the sear 134 has an engagement pin 144 extending therefrom, a first guide surface 146 and a second guide surface 148.

It is understood by those skilled in the art that one or more of the leg portions 122, 124, the curved portion 126, the interconnecting web 128, the ear 130 and the sear 134 of the transmission member 56 may be formed separately and then integrally connected together in the manner described above by suitable connecting means, such as welding and/or hardware. For example, in the preferred embodiment the leg portions 122, 124, the curved portion 126, the interconnecting web 128 and the ear 130 are formed as a unitary, one-piece structure from a single piece of material by a suitable manufacturing process, such as a stamping process, and the sear 134 constitutes a separate component which is integrally connected to the interconnecting web portion 128 of the transmission member 56 by suitable connecting means, such as hardware and/or welding. Alternatively, the entire transmission member 56 may be formed as a unitary, one-piece structure from a single piece of material by a suitable manufacturing process.

Referring back to FIGS. 3–4, the transmission member 56 is pivotally connected to the trigger 18 by means of the connecting pin 74 at the side portion 18*b* of the trigger 18 intermediate the connecting pin 74 and the free end 18*c* of the trigger 18. The transmission member 56 is displaceable toward the rear end 24 of the frame 10 along the firing path of the abutment portion 104 of the firing pin 53 by depressing the trigger 18. The transmission member 56 is also pivotal between an upper inclination, in which the sear edge 140 of the sear 134 is in the firing path and engages the abutment portion 104 of the firing pin 53, and a lower inclination, in which the sear edge 140 is displaced from the firing path and disengaged from the abutment portion 104. The transmission member 56 is biased towards its upper inclination by a biasing member 150 fixed to the frame 10 in the second locating recess 30. In the present embodiment, the biasing member 150 comprises a leaf spring having a first leg portion 150*a* fixed to the frame 10 by means of a connecting pin 152 and a second leg portion 150*b* in pressure contact with the second guide surface 148 of the sear 134.

In the assembled condition of the handgun according to the present invention, as shown in FIGS. 3 and 4, the magazine assembly 42 extends through the opening 127 of the transmission member 56. It will be understood by those of ordinary skill in the art that the dimensions of the magazine assembly 42 and the transmission member 56 are proportionally selected to freely permit the transmission member 56 to translate toward the rear end 24 of the frame 10 and to pivot between its upper and lower inclinations without interruption by the magazine assembly 42.

As shown in FIG. 3, the pivot member 92 is mounted to the frame 10 in the second locating recess 30 by means of a cross pin 154 for pivotal movement about an axis B generally transverse to the firing path of the abutment portion 104 of the firing pin 53. Prior to a firing sequence, the pivot member 92 is biased in a first direction (i.e., clockwise direction in FIG. 3) toward a first position by a biasing member 156. During a firing sequence, the pivot member 92 is pivoted in a second direction (i.e., counter-clockwise direction in FIG. 3) toward a second position by the transmission member 56 against the bias of the biasing member 156. Preferably, the biasing member 156 comprises a torsion spring.

Figure 17:
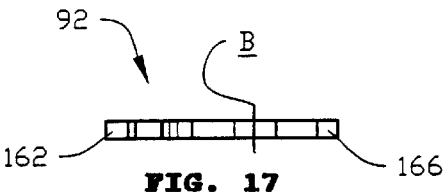
FIG. 17 is a front view of a pivot member of the firing mechanism according to the present invention.
Figure 18:
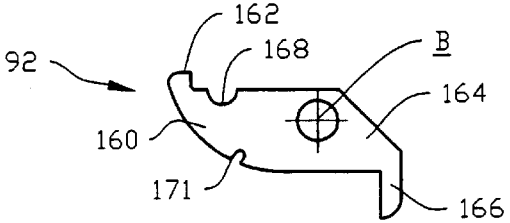
FIG. 18 is a view in side elevation of the pivot member shown in FIG. 17.

Referring now to FIGS. 17–18, the pivot member 92 comprises a first limb 160 having a hook 162 operatively engageable, when the pivot member 92 is in the first position, with the abutment portion 104 of the firing pin 53. A second limb 164 of the pivot member 92 has a hook 166 operatively engageable, when the pivot member 92 is in the second position, with the engagement pin 144 formed integral with the second leg portion 138 of the sear 134. The first limb 160 has a first slot 168 for engagement with a pin 170 integral with the frame 10 when the pivot member 92 is in the first position. The first slot 168 of the first limb 160 and the pin 170 define means for limiting pivotal movement of the pivot member 92 in the first direction. As shown in FIG. 3, the biasing member 156 has a leg portion 156*a* for engagement with a second slot 171 of the pivot member 92.

Figure 19:
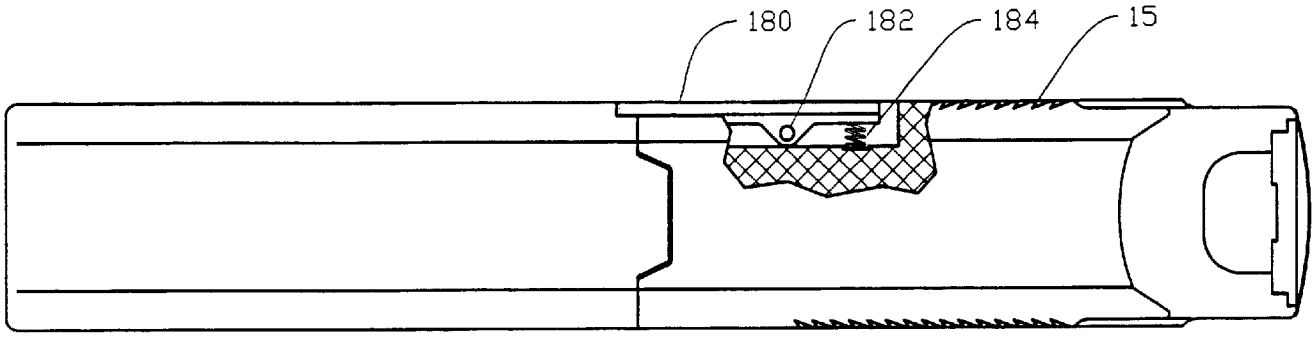
FIG. 19 is a fragmentary, partially cut-away top view of the handgun according to the present invention showing an extractor mechanism.

FIG. 19 is a fragmentary, partially cut-away top view of the handgun according to the present invention showing an extractor 180 for ejecting an empty cartridge out of an ejection port (not shown) in the slide 14 during movement of the slide 14 toward its second position upon firing a round. The extractor 180 is mounted to the slide 14 for pivotal movement by a connecting pin 182, and a biasing member 184 functions as a spring catch for retaining the extractor 180 in contact with the spent cartridge to effect extraction of the empty cartridge from the handgun when the slide is driven to the second position thereof. More specifically, during movement of the slide 14 toward its second position upon firing a round, the extractor 180 pulls the empty cartridge from the cartridge chamber 36. When the slide 14 reaches its second position, an ejecting portion 190 (FIG. 5) formed integral with the frame 10 hits a lower rim portion of the empty cartridge, expelling the empty cartridge through the ejection port in the slide 14. In the present embodiment, the ejecting portion 190 comprises a cam surface formed unitarily with the frame 10.

Preferably, the firing pin assembly 52, the transmission member 56, the recoil spring 70, the trigger spring 76, the magazine catch 82, the biasing members 88, 150, 156 and 184, the connecting pins 44, 72, 74, 86, 152 and 182, the firing spring 116, the pivot member 92, the cover plate 112 and the extractor 180 are formed of titanium. However, it is understood by those of ordinary skill in the art that other materials exhibiting a high ratio of strength to weight are suitable for these components.

Operation of the handgun according to the present invention will be explained below with reference to FIGS. 1–21.

Prior to a firing sequence, the state of the handgun is shown in FIGS. 3–4. More specifically, the sear edge 140 of transmission member 56 and the hook 162 of the pivot member 92 are in operative abutment with the abutment portion 104 of the firing pin 53 and, therefore, are disposed in the firing path of the abutment portion 104. Here, the transmission member 56 is in its upper inclination and the pivot member 92 is in its first position. In the upper inclination of the transmission member 56, as shown in FIG. 4, the cross pin 154, which is integral with the frame 10, is in operative engagement with the first guide surface 146 of the sear 134, and the second leg portion 150*b* of the biasing member 150, which is integrally connected to the frame 10, is in operative engagement with the second guide surface 148 of the sear 134. The first and second guide surfaces 146, 148 of the sear 134 are each generally oriented at an angle with respect to the central axis A of the barrel bore 34 and define cam surfaces which coact with the cross pin 154 and the second leg portion 150*b* of the biasing member 150, respectively, when the transmission member 56 is displaced toward the rear end 24 of the frame 10. As shown in FIG. 4, the first and second guide surfaces 146, 148 are inclined upwardly and downwardly, respectively, in the direction of the front end 22 of the frame 10. As described more specifically below, the cross pin 154 and the first guide surface 146 of the transmission member 56 define means for displacing the transmission member 56 from its upper inclination to its lower inclination during a firing sequence of the handgun.

In use, if a cartridge 38 is not already positioned in the cartridge chamber 36, the slide 14 is first manually moved rearward toward the rear end 24 of the frame 10 against the bias of the recoil spring 70 and then released. By this operation, the slide 14 is allowed to be moved forward towards the front end 22 of the frame 10 under the bias of the recoil spring 70 causing a cartridge to be pushed off the top of the magazine assembly 42, up the feed ramp 40*a* and into the cartridge chamber 36.

Upon depressing the trigger 18 to fire a round from the state of the handgun shown in FIGS. 3 and 4, the transmission member 56, which is pivotally connected to the trigger 18 as described above, is displaced toward the rear end 24 of the frame 10 while the sear edge 140, which is in operative abutment with the abutment portion 104 of the firing pin 53, pulls the firing pin 53 reardwardly and compresses the firing spring 116. Simultaneous with this operation, the transmission member 56 is displaced toward its lower inclination (i.e., downward in FIG. 4) against the bias of the biasing member 150 by means of the operative engagement between the cross pin 154 and the first guide surface 146 of the sear 134.

Figure 20:
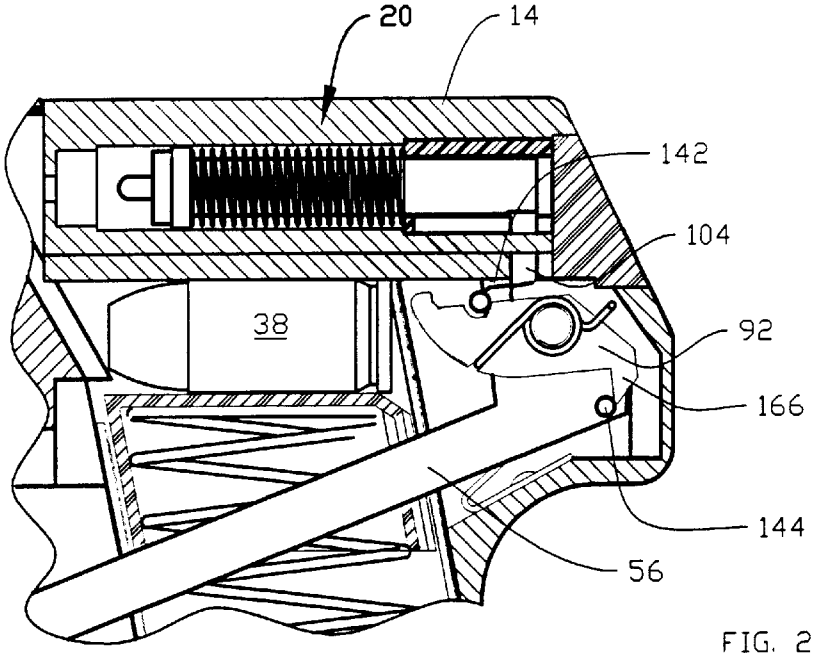
FIG. 20 is a fragmentary right side sectional view of the firing mechanism of the present invention during a firing sequence.

As displacement of the transmission member 56 progresses toward its lower inclination, the engagement pin 144 of the sear 134 engages the hook 166 of the pivot member 92 and pivots the pivot member 92 from its first position to its second position to clear the hook 162 from the firing path of the abutment portion 104 of the firing pin 53. The state of the firing mechanism 20 at this point is shown in FIG. 20. By following through with the complete depression of the trigger 18, the transmission member 56 reaches its lower inclination, at which point the sear edge 140 will ultimately disengage the abutment portion 104 of the firing pin 53, thereby releasing the firing pin 53 under compression of the firing spring 116. The firing pin 53 then rapidly moves towards its fire condition under the bias of the firing spring 116 until the second guide member 108 stops on the second shoulder 50*e* of the slide elongate passage 50. The firing pin 53 then continues to travel forward through guidance of the guiding portion 102 and the first guide member 106 until the pin 100 passes through the opening 71 of the slide elongate passage 50 and strikes the primer of the live cartridge 38 disposed in the cartridge chamber 36 which causes ignition and fires a round.

Figure 21:
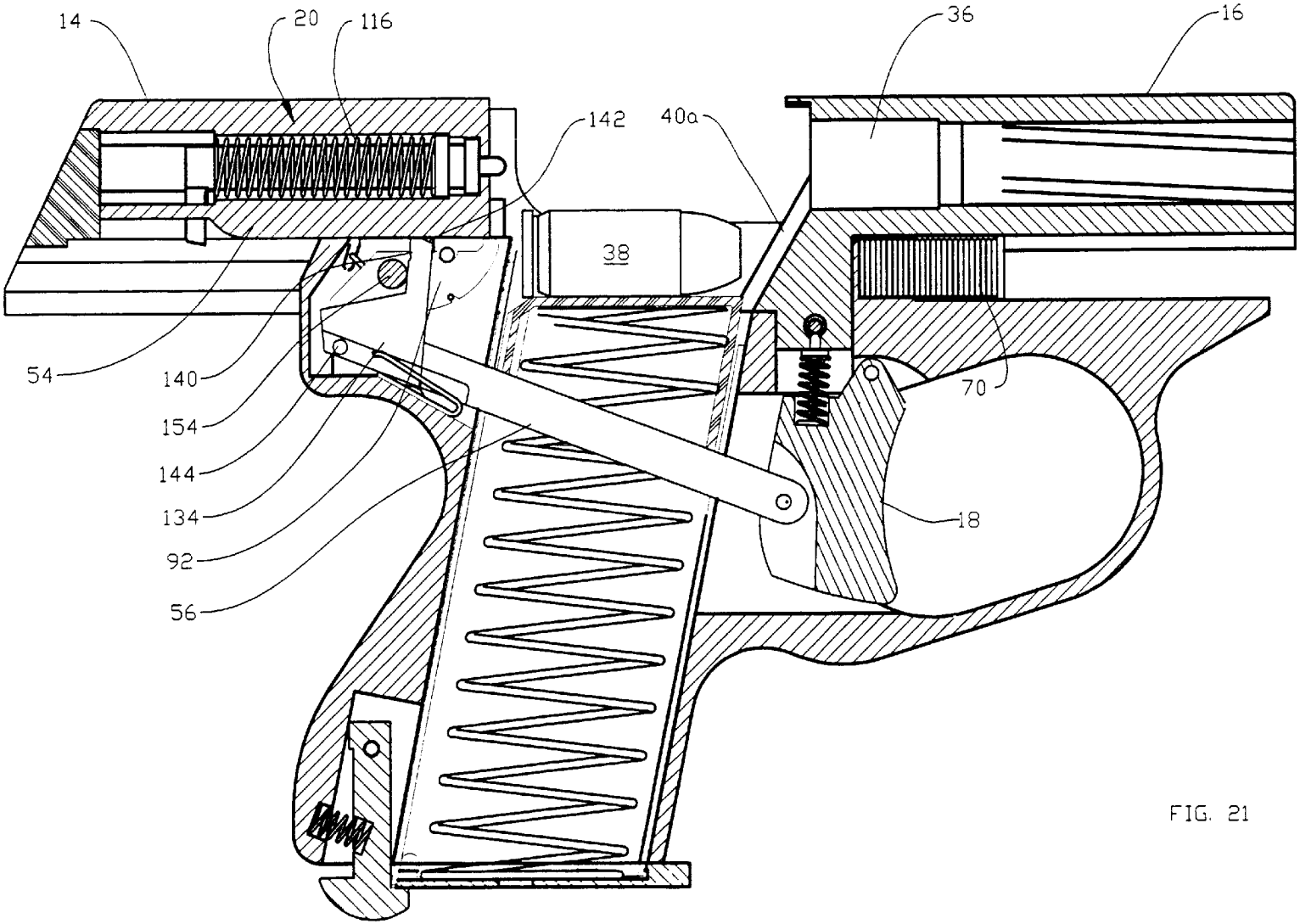
FIG. 21 is a left side longitudinal sectional view of the handgun according to the present invention showing the slide in its most rearward position.

As a result of the energy released upon firing the round, the slide 14 is moved toward the rear end 24 of the frame 10 and, in doing so, compresses the recoil spring 70. During rearward cycling of the slide 14, the resetting surface 54 of the slide 14 engages the bumper surface 142 of the sear 134, causing the transmission member 56 to displace further to its lower inclination and disengage the engagement pin 144 from the pivot member 92, thereby pivoting the pivot member 92, under the bias of the biasing member 156, toward its first position. The state of the firing mechanism 20 at this point is shown in FIG. 21. Also during rearward cycling of the slide 14, the empty cartridge is extracted from the chamber 36 by the extractor 180. When the slide 14 reaches its most rearward position (i.e., its second position shown in FIG. 21), the ejecting portion 190 (FIG. 5), which is formed integral with the frame 10, hits a lower rim portion of the empty cartridge, expelling the empty cartridge through the ejection port in the slide 14.

Compression of the recoil spring 70 continues until the kinetic energy, having been imparted to the slide 14, is reduced to a level wherein the potential energy being imparted to the recoil spring 70 as it is compressed becomes greater than the kinetic energy. When that occurs, the recoil spring 70 will begin to expand and, in doing so, will return the slide 14 forward toward its first position, causing a cartridge 38 to be pushed off the top of the magazine assembly 42, up the feed ramp 40*a* and into the cartridge chamber 36.

Upon complete return of the slide 14 to its first position, the pivot member 92 will prevent the firing pin 53 from moving forward toward the firing condition. Releasing the user's finger from the trigger 18 allows the spring 76 to reset the trigger 18 to its forward position, which in turn causes the transmission mechanism 56 to return to its upper inclination (i.e., to the ready to fire condition) under the bias of the biasing member 150. The transmission member 56 and the pivot member 92 thus arrest the firing pin 53 in its uncocked condition.

The handgun can then be used again by the user to fire a second round by depressing the trigger 18 to repeat the process.

It will be appreciated by those skilled in the art that the operative abutment between the abutment portion 104 of the firing pin 53 and the sear edge 140 of the transmission member 52 and the formation 162 of the pivot member 92, in the state of the handgun prior to a firing sequence shown in FIGS. 3–4, is arranged to take place in an uncocked condition of the firing pin assembly 52. More specifically, the operative abutment is arranged to take place at a point where the guiding portion 102 of the firing pin 53 engages the second shoulder 50*e* of the slide elongate passage 50 and the pin 100 of the firing pin 53 extends into the opening 71 of the slide elongate passage 50. By this construction, a highly reliable safety feature is realized for the handgun. That is, the handgun will not fire accidentally, e.g., by dropping it or through failure of a component, because the firing spring 116 in this state is not arranged under compression and, therefore, will not have sufficient energy to propel the firing pin assembly 52 toward its firing condition.

The handgun according to the present invention has the additional safety feature that the pivot member 92 functions as a safety sear which prevents the firing pin 53 from moving towards its firing condition by means of the operative abutment between the formation 162 of the pivot member 52 and the abutment portion 104 of the firing pin 53. Thus, unless the firing pin spring 116 is sufficiently compressed by pressing the trigger 18 to pull the firing pin 53 rearward toward the rear end 24 of the frame 10 against the bias of the firing pin spring 116 and then released, the firing pin 53 will not be propelled towards its firing condition with a sufficiently strong, predetermined force to permit the pin 100 to strike the primer of the cartridge 38 in the cartridge chamber 36 and fire the round.

From the foregoing construction and operation of the handgun according to the present invention, it will be appreciated that the trigger 18 and the firing mechanism 20 constitute a double-action trigger and firing assembly. Stated otherwise, depression of the trigger 18 from the state of the handgun shown in FIGS. 3–4 both cocks and releases the firing pin 53 to fire a round. This features allow for a smoother, simpler and more consistent trigger action providing improved firing accuracy over conventional handguns.

It will also be appreciated that the double-action trigger and firing assembly of the handgun according to the present invention consists of only four moving parts (i.e., trigger 18, transmission member 56, pivot member 92 and firing pin 53) and four springs (i.e., trigger spring 76, firing spring 116 and springs 150, 156). By this construction, the number of moving components is reduced to a minimum, thereby providing a handgun which is lightweight, compact and economical to manufacture, and in which the interaction of components is reliable and simple.

Another advantage of the foregoing construction of the handgun according to the present invention is that it facilitates maintenance and provides for improved assembly and disassembly of the components thereof.

A second embodiment of the handgun according to the present invention, as shown in FIGS. 22–26, comprises the elements described above with reference to the embodiment of FIGS. 1–21. However, the handgun according to the second embodiment additionally employs a safety mechanism for inhibiting operation and thereby prevents the unauthorized firing of the handgun.

Figure 22:
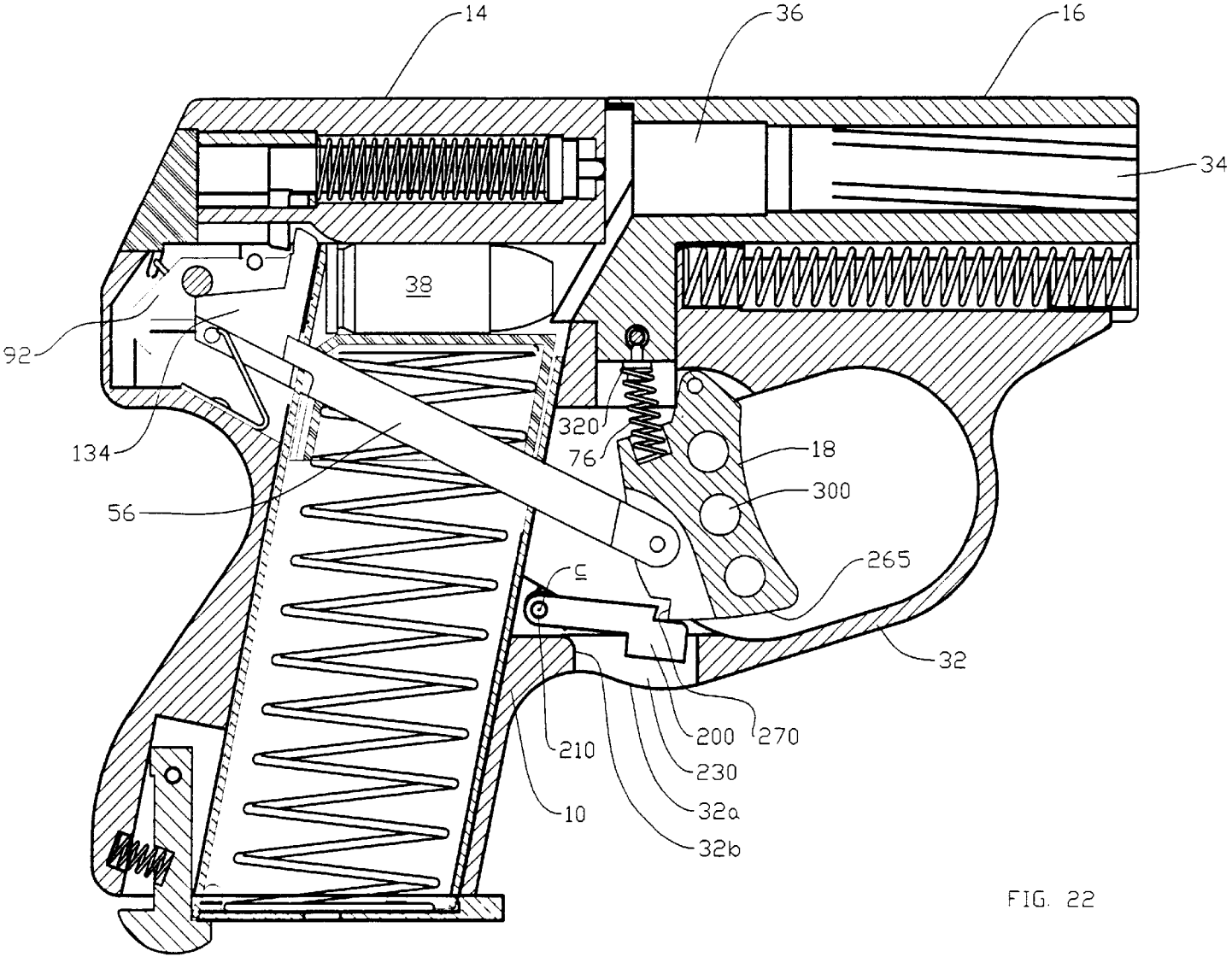
FIG. 22 is a left side longitudinal sectional view of the handgun according to a second embodiment of the present invention.
Figure 23:
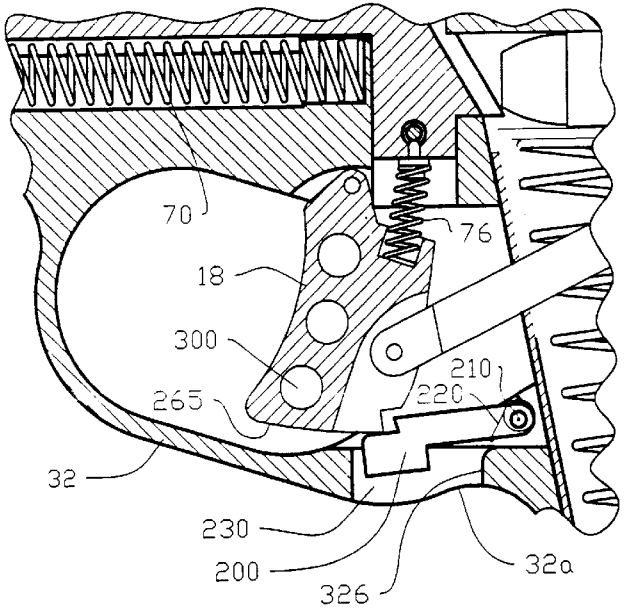
FIG. 23 is a fragmentary right side sectional view of the handgun according to the second embodiment showing a safety mechanism.
Figure 24:
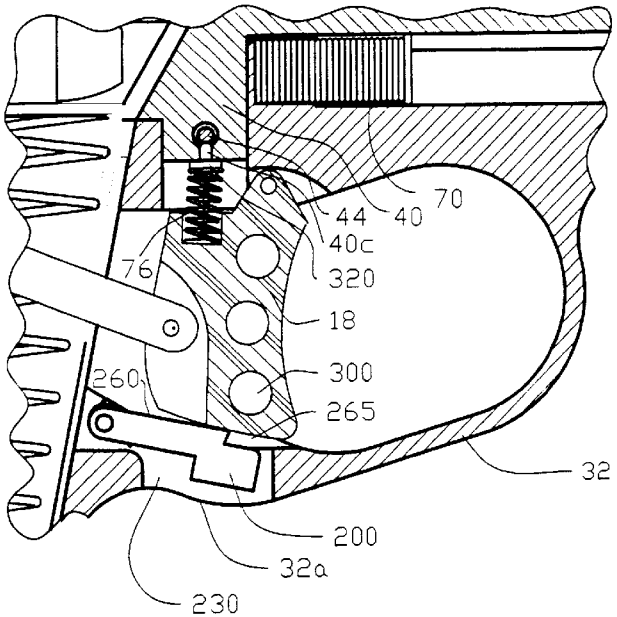
FIG. 24 is a fragmentary left side sectional view of the handgun according to the second embodiment during a firing sequence.

Referring to FIGS. 22–25, the safety mechanism has a magnetically actuable locking member 200 mounted at one end thereof to the frame 10 by means of a connecting pin 210 for pivotal movement between first and second positions about an axis C generally transverse to the central axis A of the barrel bore 34. In the first position, as shown in FIGS. 22 and 23, the magnetically actuable locking member 200 is engageable with and blocks rearward movement of the trigger 18 to the rearward, depressed position thereof. In the second position, as shown in FIG. 24, the magnetically actuable locking member 200 is moved out of blocking relationship with the trigger 18 whereby the trigger 18 is free to move rearwardly to the rearward, depressed position.

The magnetically actuable locking member 200 is normally positioned in blocking relationship with the trigger 18 (i.e., in the first position) by means of a biasing member 220, such as a torsion spring as shown in FIG. 23. A portion of the trigger guard 32 below the trigger 18 has formed therein a recessed area 230 which allows pivoting movement of the magnetically actuable locking member 200 to the second position (i.e., out of blocking relationship with the trigger 18). The recessed area 230 is defined by an outer surface portion 32*a* and an inner wall surface 32*b* of the trigger guard 32. The magnetically actuable locking member 200 is composed of magnetic material so as to be attracted by a magnet (not shown but described hereinafter) for movement out of blocking relationship with the trigger 18 against the bias of the biasing member 220 when the magnet is brought into close proximity with the magnetically actuable locking member 200. In this state, as shown in FIG. 24, the magnetically actuable locking member 200 pivots downward into the recessed area 230 (i.e., the second position). If the magnet is subsequently removed, the biasing member 220 will return the magnetically actuable locking member 200 into blocking relationship with the trigger 18.

Figure 25:
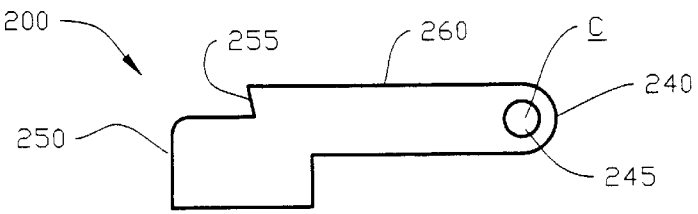
FIG. 25 is a view in side elevation of a magnetically actuable member of a safety mechanism according to the present invention.

As shown in FIG. 25, the magnetically actuable looking member 200 has a first end 240 provided with a hole 245 through which the connecting pin 210 is extendable, a second end 250 having an engagement portion or notch 255, and an upper surface portion 260 disposed between the first and second ends 240, 250. The trigger 18, as shown in FIGS. 22 and 23, has a base portion 265 terminating at one end thereof in an engagement portion in the form of a notch 270 for engagement with the notch 255 of the magnetically actuable locking member 200 when the locking member 200 is in blocking relationship with the trigger 18.

In operation, as shown in FIGS. 22 and 23, the magnetically actuable locking member 200 is biased to the first position by the biasing member 220 to block rearward movement of the trigger 18. Thus, in the state shown in FIGS. 22 and 23, when the trigger 18 is initially depressed, the notch 270 of the trigger 18 engages the notch 255 of the magnetically actuable locking member 200 and prevents complete release of the trigger 18, thereby preventing the firing of a round.

Figure 27:
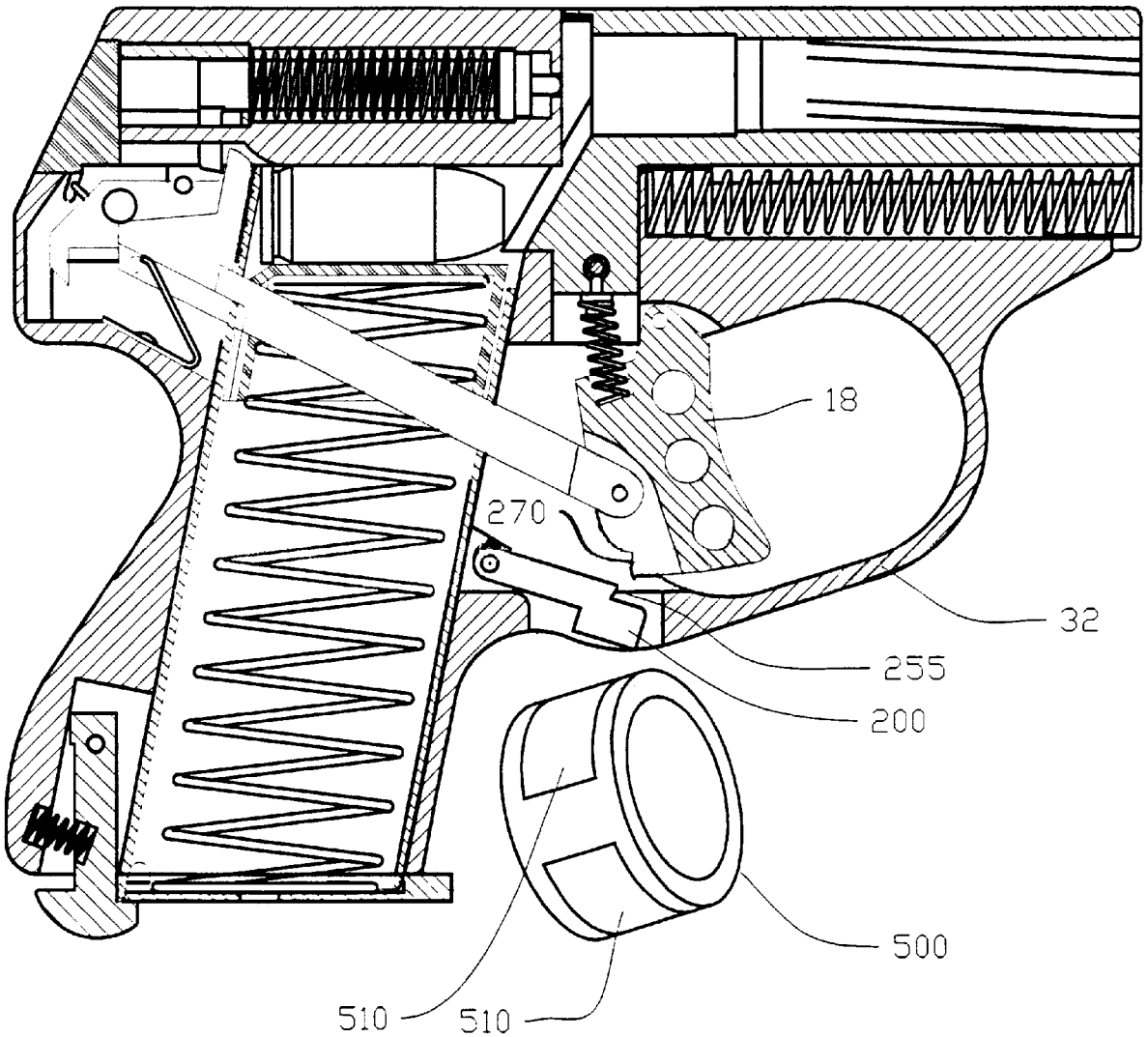
FIG. 27 is a left side longitudial sectional view of the handgun according to the second embodiment showing a magnetic element for releasing the safety mechanism.

To release the safety device and allow complete depression of the trigger 18 to fire a round, a magnetic element is brought into close proximity with the outer surface portion 32*a* of the trigger guard 32. As shown in FIG. 27, the magnetic element can comprise, or example, a ring 500 containing a magnet 510, which is worn on the finger of the gun-gripping hand by the user of the handgun. Magnetic forces from the magnet cause the magnetically actuable locking member 200 to pivot from the first position to the second position by magnetic attraction to thereby move the notch 255 of the magnetically actuable locking member 200 out of blocking relationship with the notch 270 of the trigger 18 and to allow free movement of the trigger 18 to the rearward, depressed position, as shown in FIG. 24. Thus, the trigger can then be fully released to fire a round. Accordingly, when a user wearing a magnet-containing ring grips the trigger guard 32, the magnet attracts the locking member 200 out of its locking position thereby freeing the trigger 18 so that the handgun may be fired.

As shown in FIG. 24, during depression of the trigger 18 to fire a round, the base portion 265 of the trigger 18 remains in contact with the upper surface portion 260 of the magnetically actuable locking member 200, forcing the locking member 200 further into the recessed area 230 of the trigger guard 32 against the bias of the biasing member 220, through the firing of a round. After the round has been fired, the trigger 18 returns to its forward, rest position, as described above for the embodiment of FIGS. 1–21. Thereafter, while continuing to grip the trigger guard 32 so as to position the magnet-containing ring in proximity to the outer surface portion 32*a,* as described above, the user wearing the ring can fire subsequent rounds since the magnetically actuable locking member 200 will remain out of blocking relationship with the trigger 18. In contrast, if the user removes his hand from the trigger guard 32 so as to bring the magnet-containing ring out of proximity to the outer surface portion 32*a* of the trigger guard 32, thereby effectively extinguishing the effect of the magnetic attracting force, the magnetically actuable locking member 200 returns to its first position (i.e., in blocking relationship with the trigger 18). More specifically, when the required magnetic attracting force for attracting the magnetically actuable locking member 200 to the second position has been removed, the force applied by the trigger 18 on the magnetically actuable locking member 200 against by the bias of the biasing member 220 is released as the trigger 18 returns to its forward, rest position, allowing the locking member 200 to return to its first position into blocking engagement with the trigger 18 as shown in FIGS. 22–23.

The frame 10, or at least the trigger guard 32, is preferably formed of a non-magnetic or non-ferrogeneous material. Accordingly, in the present embodiment no magnetic forces from the frame 10 will act on the magnetically actuable locking member 200 when the locking member is in blocking relationship with the trigger 18 (i.e., in the first position).

As described above for the embodiment of FIGS. 1–21, an object of the present invention is to provide a handgun which is of light weight and compact construction. In order to further achieve these objects, according to another embodiment of the present invention shown in FIGS. 22–24, the trigger 18 is provided with holes 300 for reducing the weight of the trigger 18 and, therefore, the overall weight of the assembled handgun. In this embodiment, three circular holes 300 are formed along one side of the trigger 18. However, it will be appreciated by those of ordinary skill in the art that the number, location and configuration of the holes 300 on the trigger 18 may be varied so long as the structural strength of the trigger 18 is not compromised.

Figure 26:
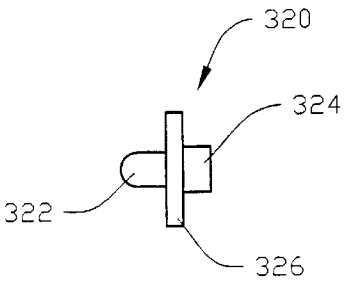
FIG. 26 is a view in side elevation of a detent used in the handgun according to the present invention.

In the first embodiment of the present invention described above with reference to FIGS. 1–21, the barrel support portion 40 is mounted to the frame 10 by the connecting pin 44 which extends through the hole 40*d* in the barrel support portion 40 and the corresponding aligned holes in the frame 10 and is held therein with a friction fit. In the second embodiment shown in FIGS. 22–24, however, the end of trigger spring 76 opposite the end thereof in contact with the trigger 18 is supported by a detent 320 which further secures the connecting pin 44 within the hole 44*d* and corresponding aligned holes in the frame 10. More specifically, as shown in FIG. 26, the detent comprises a pin portion 322, a guide portion 324 having a diameter greater than the pin portion 322, and a shoulder portion 326 disposed between the pin portion 322 and the guide portion 324 and having a diameter greater than the guide portion 324. As shown in FIGS. 22–24, the shoulder portion 326 supports the second end of the trigger spring 76 while the guiding portion 324 guides the trigger spring during movement of the trigger 18 between its forward and rearward positions. A lower surface of the barrel support portion 40 is formed with a hole 40*c* extending generally perpendicular to and communicating with the hole 44*d* of the barrel support portion 40. The pin portion 322 of the detent 320 extends into the hole 40*c* of the barrel support portion 40 and contacts the connecting pin 44 with a preselected pressure. By this construction, the connecting pin 44 is further secured within the hole 44*d* of the barrel support portion 40 and corresponding aligned holes in the frame 10 to prevent accidental withdrawal therefrom without altering the compactness of the overall structure of the handgun.

Although the provision of the holes 300 in the trigger 18 and the detent 320 are disclosed in connection with the second embodiment shown in FIGS. 22–24, it will be appreciated by those of ordinary skill in the art that these features are equally applicable to the handgun described above for the embodiment of FIGS. 1–21.

The preferred material for the connecting pin 210, the biasing member 220 and the detent 320 is titanium. However, other materials exhibiting a high ratio of strength to weight are suitable for these components.

It will be appreciated by those of ordinary skill in the art that the unique construction and the combination of materials from which the handgun of the present invention is comprised results in a highly versatile handgun which is light weight, compact and economical to manufacture, in which specialty tooling for the manufacture thereof is kept to a minimum, in which the number of moving components is reduced to a minimum and the interaction of these components is reliable and simple, which has constructional features which provide for improved assembly and disassembly of the components thereof, and which provides a safety mechanism which is simple in construction and which can reliably inhibit unauthorized operation of the handgun.

Moreover, the inventive handgun, which may be manufactured in any size and weight, is highly durable and resistant to structural or performance degradation. Thus the handgun according to the present invention is particularly well adapted for use in self-defense situations and by trained professionals for instructional purposes.

It will also be appreciated by those of ordinary skill in the art that the method of the present invention provides for the operation of a handgun by smooth, consistent trigger action providing improved accuracy.

From the foregoing description, it can be seen that the present invention comprises an improved handgun and an improved method of operating a handgun. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. A handgun comprising: a frame: a trigger mounted on the frame for movement between a rest position and a depressed position; a firing pin assembly having a firing pin movable between a cocked condition remote from a cartridge chamber and a fire condition proximate the cartridge chamber, the firing pin having an abutment portion integral therewith for movement along a firing path during movement of the firing pin between the cocked condition and the fire condition; a first biasing member for biasing the firing pin toward the fire condition; a transmission member having an abutment surface for abutment with the abutment portion of the firing pin, the transmission member being movable between a first position in which the abutment surface is disposed in the firing path and abuts the abutment portion of the firing pin, and a second position in which the abutment surface is not disposed in the firing path and does not abut the abutment portion of the firing pin, the transmission member being responsive, in the first position thereof, to depression of the trigger to displace the firing pin against the bias of the first biasing member toward the cocked condition followed by subsequent movement of the transmission member to the second position to release the firing pin to the fire condition; a second biasing member for biasing the transmission member toward the first position thereof; and a pivot member mounted on the frame for pivotal movement between a first position and a second position, the pivot member having a first limb engageable with the abutment portion of the firing pin in the first position of the pivot member and a second limb engageable with the transmission member in the second position of the pivot member.

2. A handgun according to claim 1; further comprising a third biasing member for biasing the pivot member toward the first position thereof.

3. A handgun according to claim 1, wherein the transmission member has an engagement element engageable with the second limb of the pivot member in response to depression of the trigger to pivot the pivot member from the first position to the second position thereof to deflect the first limb of the pivot member from abutment with the abutment portion of the firing pin.

4. A handgun according to claim 3; further comprising a third biasing member for biasing the pivot member toward the first position thereof.

5. A handgun according to claim 3; further comprising a resetting surface slidingly displaceable relative to the transmission member for contacting and moving the transmission member to disengage the engagement element of the transmission member from the second limb of the pivot ember and thereby allow the pivot member to pivot to the first position.

6. A handgun according to claim 1; further comprising a deflecting element fixed to the frame; and wherein the transmission member has a guide surface engageable with the deflecting element of the frame to deflect the transmission member toward the second position thereof against the bias of the second biasing member in response to depression of the trigger.

7. A handgun according to claim 6; wherein the deflecting element comprises a pin extending generally transverse to the firing path; and wherein the pivot member is mounted on the pin for pivotal movement between the first and second positions thereof.

8. A handgun according to claim 1; further comprising a locking mechanism for locking the trigger in the rest position to prevent movement of the trigger to the depressed position.

9. A handgun according to claim 8; wherein the locking mechanism comprises a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position.

10. A handgun according to claim 9; wherein the frame has a recessed portion adjacent the locking member for permitting the locking member to pivot to the second position thereof against the bias of the biasing member.

11. A handgun according to claim 10; wherein the locking member is made of a magnetic material responsive to a magnetic element which is brought proximate the recessed portion of the frame to cause the locking member to pivot to the second position thereof against the bias of the biasing member.

12. A handgun according to claim 9; wherein the locking member is made of a magnetic material responsive to a magnetic element which is brought proximate thereto to cause the locking member to pivot to the second position thereof against the bias of the biasing member.

13. A handgun according to claim 8; wherein the trigger has a plurality of holes extending therethrough at preselected positions along the trigger for reducing the weight of the trigger.

14. A handgun according to claim 1, wherein the trigger has a plurality of holes extending therethrough at preselected positions along the trigger for reducing the weight of the trigger.

15. A handgun comprising: a frame; a trigger mounted on the frame for movement between a rest position and a depressed position; a firing pin movable along a firing path between a cocked condition remote from a cartridge chamber and a fire condition proximate the cartridge chamber for firing a cartridge; a biasing member for biasing the firing pin toward the fire condition; a transmission member disposed between the trigger and the firing pin and extending in the firing path at least in the cocked condition of the firing pin, the transmission member being movable in response to depression of the trigger to displace the firing pin against the bias of the biasing member toward the cocked condition; deflecting means for deflecting the transmission member out of the firing path of the firing pin to release the firing pin from the cocked condition and allow the firing pin to be propelled by the biasing member to the fire condition to fire the cartridge; and a pivot member mounted on the frame for pivotal movement between a first position and a second position, the pivot member having a first limb engageable with the firing pin in the first position of the pivot member and a second limb engageable with the transmission member in the second position of the pivot member.

16. A handgun according to claim 15; wherein the transmission member has an engagement element engageable with the second limb of the pivot member in response to depression of the trigger to pivot the pivot member from the first position to the second position thereof to deflect the first limb of the pivot member from engagement with the firing pin.

17. A handgun according to claim 16; further comprising a resetting surface slidingly displaceable relative to the transmission member for contacting and moving the transmission member to disengage the engagement element of the transmission member from the second limb of the pivot member and thereby allow the pivot member to pivot to the first position.

18. A handgun according to claim 15; further comprising means for inhibiting depression of the trigger to thereby prevent the movement of the firing pin to the cocked condition and the subsequent release of the firing pin to the fire condition to fire the cartridge.

19. A handgun according to claim 15; further comprising a locking mechanism for locking the trigger in the rest position to prevent movement of the trigger to the depressed position.

20. A handgun according to claim 19; wherein the locking mechanism comprises a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position.

21. A handgun according to claim 20; wherein the frame has a recessed portion adjacent the locking member for permitting the locking member to pivot to the second position thereof against the bias of the biasing member.

22. A handgun according to claim 21; wherein the locking member is made of a magnetic material responsive to a magnetic element which is brought proximate the recessed portion of the frame to cause the locking member to pivot to the second position thereof against the bias of the biasing member.

23. A handgun according to claim 20; wherein the locking member is made of a magnetic material responsive to a magnetic element which is brought proximate thereto to cause the locking member to pivot to the second position thereof against the bias of the biasing member.

24. A handgun according to claim 19; wherein the trigger has a plurality of holes extending therethrough at preselected positions along the trigger for reducing the weight of the trigger.

25. A handgun according to claim 15; wherein the trigger has a plurality of holes extending therethrough at preselected positions along the trigger for reducing the weight of the trigger.

26. A method of operating a handgun, comprising the steps of: providing a handgun having a frame, a trigger mounted on the frame for movement between a rest position and a depressed position, a firing pin movable along a firing path between a cocked condition remote from a cartridge chamber and a fire condition proximate the cartridge chamber for firing a cartridge, a biasing member for biasing the firing pin toward the fire condition, a transmission member disposed between the trigger and the firing pin and extending in the firing path at least in the cocked condition of the firing pin for transmitting the motion of the trigger to the firing pin, a deflecting element fixed to the frame for deflecting the transmission member out of the firing path of the firing pin, and a pivot member mounted on the deflecting element for pivotal movement between a first position in which the pivot member is disposed in the firing path of the firing pin and a second position in which the pivot member is pivoted out of the firing path of the firing pin; transmitting the motion of the trigger, while being depressed, to the firing pin by displacing the transmission member to displace the firing pin to the cocked condition against the bias of the biasing member; and deflecting the transmission member out of the firing path of the firing pin, in response to continued displacement of the transmission member, by the deflecting element to pivot the pivot member to the second position thereof to thereby release the firing pin from the cocked condition and allow the firing pin to be propelled by the biasing member to the fire condition to fire the cartridge.

27. A handgun comprising: a frame; a trigger mounted on the frame for movement between a rest position and a depressed position; a firing pin assembly having a firing pin movable between a cocked condition remote from a cartridge chamber and a fire condition proximate the cartridge chamber, the firing pin having an abutment portion integral therewith for movement along a firing path during movement of the firing pin between the cocked condition and the fire condition; a first biasing member for biasing the firing pin toward the fire condition; a transmission member having an abutment surface for abutment with the abutment portion of the firing pin, the transmission member being movable between a first position in which the abutment surface is disposed in the firing path and abuts the abutment portion of the firing pin, and a second position in which the abutment surface is not disposed in the firing path and does not abut the abutment portion of the firing pin, the transmission member being responsive, in the first position thereof, to depression of the trigger to displace the firing pin against the bias of the first biasing member toward the cocked condition followed by subsequent movement of the transmission member to the second position to release the firing pin to the fire condition; a second biasing member mounted on the frame and disposed between the frame and the transmission member for biasing the transmission member toward the first position thereof; and a locking mechanism for locking the trigger in the rest position to prevent movement of the trigger to the depressed position, the locking mechanism having a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position, the frame having a recessed portion adjacent the locking member for permitting the locking member to pivot to the second position thereof against the bias of the biasing member, and the locking member being made of a magnetic material responsive to a magnetic element which is brought proximate the recessed portion of the frame to cause the locking member to pivot to the second position thereof against the bias of the biasing member.

28. A handgun comprising: a frame; a trigger mounted on the frame for movement between a rest position and a depressed position; a firing pin assembly having a firing pin movable between a cocked condition remote from a cartridge chamber and a fire condition proximate the cartridge chamber, the firing pin having an abutment portion integral therewith for movement along a firing path during movement of the firing pin between the cocked condition and the fire condition; a first biasing member for biasing the firing pin toward the fire condition; a transmission member having an abutment surface for abutment with the abutment portion of the firing pin, the transmission member being movable between a first position in which the abutment surface is disposed in the firing path and abuts the abutment portion of the firing pin, and a second position in which the abutment surface is not disposed in the firing path and does not abut the abutment portion of the firing pin, the transmission member being responsive, in the first position thereof, to depression of the trigger to displace the firing pin against the bias of the first biasing member toward the cocked condition followed by subsequent movement of the transmission member to the second position to release the firing pin to the fire condition; a second biasing member mounted on the frame and disposed between the frame and the transmission member for biasing the transmission member toward the first position thereof; and a locking mechanism for locking the trigger in the rest position to prevent movement of the trigger to the depressed position, the locking mechanism having a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position, the locking member being made of a magnetic material responsive to a magnetic element which is brought proximate thereto to cause the locking member to pivot to the second position thereof against the bias of the biasing member.

29. A handgun comprising: a frame; a trigger mounted on the frame for movement between a rest position and a depressed position; a firing pin assembly having a firing pin movable between a cocked condition remote from a cartridge chamber and a fire condition proximate the cartridge chamber, the firing pin having an abutment portion integral therewith for movement along a firing path during movement of the firing pin between the cocked condition and the fire condition; a transmission member having an abutment surface for abutment with the abutment portion of the firing pin, the transmission member being movable between a first position in which the abutment surface is disposed in the firing path and abuts the abutment portion of the firing pin in the cocked condition of the firing pin, and a second position in which the abutment surface is not disposed in the firing path and does not abut the abutment portion of the firing pin in the fire condition of the firing pin; and a pivot member mounted on the frame for pivotal movement between a first position in which the pivot member is disposed in the firing path and abuts the abutment portion of the firing pin in the cocked condition of the firing pin, and a second position in which the pivot member is not disposed in the firing path and does not abut the abutment portion of the firing pin in the fire condition of the firing pin.

30. A handgun according to claim 29; wherein the pivot member has a first limb engageable with the abutment portion of the firing pin in the first position of the pivot member and a second limb engageable with the transmission member in the second position of the pivot member.

31. A handgun according to claim 29; further comprising a biasing member for biasing the transmission member toward the first position thereof.

32. A handgun according to claim 31; wherein the biasing member comprises a leaf spring.

33. A handgun according to claim 32; wherein the leaf spring has a first leg portion engaged with the frame and a second leg portion in pressure contact with a surface of the transmission member.

34. A handgun according to claim 31; wherein the biasing member has a first leg portion engaged with the frame and a second leg portion in pressure contact with a surface of the transmission member.

35. A handgun according to claim 31; wherein the frame has a forward end, a rear end, a first locating recess disposed over the trigger and between the forward end and the rear end, and a second locating recess disposed at the rear end; and further comprising a second biasing member disposed in the second locating recess of the frame for biasing the transmission member toward the first position thereof.

36. A handgun according to claim 29; further comprising a locking mechanism for locking the trigger in the rest position to prevent movement of the trigger to the depressed position.

37. A handgun according to claim 36; wherein the locking mechanism comprises a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position.

38. A handgun according to claim 37; wherein the frame has a recessed portion adjacent the locking member for permitting the locking member to pivot to the second position thereof against the bias of the biasing member.

39. A handgun according to claim 38; wherein the locking member is made of a magnetic material responsive to a magnetic element which is brought proximate the recessed portion of the frame to cause the locking member to pivot to the second position thereof against the bias of the biasing member.

40. A handgun according to claim 37; wherein the locking member is made of a magnetic material responsive to a magnetic element which is brought proximate thereto to cause the locking member to pivot to the second position thereof against the bias of the biasing member.

41. A handgun comprising: a frame having a forward end, a rear end, a first locating recess disposed between the forward end and the rear end, and a second locating recess disposed at the rear end; a trigger mounted on the frame for movement between a rest position and a depressed position; a firing pin movable along a firing path between a cocked condition remote from a cartridge chamber and a fire condition proximate the cartridge chamber for firing a cartridge; a first biasing member for biasing the firing pin toward the fire condition; a transmission member disposed between the trigger and the firing pin and extending in the firing path at least in the cocked condition of the firing pin, the transmission member being movable in a first direction toward the second locating recess of the frame in response to depression of the trigger to displace the firing pin against the bias of the biasing member toward the cocked condition; a second biasing member disposed in the second locating recesses of the frame for biasing the transmission member in a second direction away from the second locating recess of the frame; deflecting means for moving the transmission member in the first direction to deflect the transmission member out of the firing path of the firing pin to release the firing pin from the cocked condition and allow the firing pin to be propelled by the first biasing member to the fire condition to fire the cartridge; and a locking mechanism for locking the trigger in the rest position to prevent movement of the trigger to the depressed position, the locking mechanism having a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position, the frame having a recessed portion adjacent the locking member for permitting the locking member to pivot to the second position thereof against the bias of the biasing member, and the locking member being made of a magnetic material responsive to a magnetic element which is brought proximate the recessed portion of the frame to cause the locking member to pivot to the second position thereof against the bias of the biasing member.

42. A handgun comprising: a frame having a forward end, a rear end, a first locating recess disposed between the forward end and the rear end, and a second locating recess disposed at the rear end; a trigger mounted on the frame for movement between a rest position and a depressed position; a firing pin movable along a firing path between a cocked condition remote from a cartridge chamber and a fire condition proximate the cartridge chamber for firing a cartridge; a first biasing member for biasing the firing in toward the fire condition; a transmission member disposed between the trigger and the firing pin and extending in the firing path at least in the cocked condition of the firing pin, the transmission member being movable in a first direction toward the second locating recess of the frame in response to depression of the trigger to displace the firing pin against the bias of the biasing member toward the cocked condition; a second biasing member disposed in the second locating recesses of the frame for biasing the transmission member in a second direction away from the second locating recess of the frame; deflecting means for moving the transmission member in the first direction to deflect the transmission member out of the firing path of the firing pin to release the firing pin from the cocked condition and allow the firing pin to be propelled by the first biasing member to the fire condition to fire the cartridge; and a locking mechanism for locking the trigger in the rest position to prevent movement of the trigger to the depressed position, the locking mechanism having a locking member mounted on the frame for pivotal movement between a first position in which the locking member is engageable with and prevents movement of the trigger to the depressed position and a second position in which the locking member does not engage the trigger and is free to move to the depressed position upon depression of the trigger, and a biasing member for biasing the locking member to the first position, the locking member being made of a magnetic material responsive to a magnetic element which is brought proximate thereto to cause the locking member to pivot to the second position thereof against the bias of the biasing member.

43. A method of operating a handgun, comprising the steps of:

providing a handgun having a frame, a trigger mounted on the frame for pivotal movement between a rest position and a depressed position, a cartridge chamber for storing a cartridge, a firing pin movable along a firing path between a cocked condition and a fire condition for firing the cartridge, a biasing member for biasing the firing pin toward the fire condition, a transmission member for transmitting the motion of the trigger to the firing pin, and a pivot member mounted on the frame for pivotal movement between a first position in which the pivot member is disposed in the firing path and a second position in which the pivot member is pivoted out of the firing path;

depressing the trigger to transmit the motion of the trigger to the firing pin by displacing the transmission member to displace the firing pin to the cocked condition against the bias of the biasing member; and deflecting the transmission member out of the firing path of the firing pin, in response to continued displacement of the transmission member, to pivot the pivot member to the second position thereof to thereby release the firing pin from the cocked condition and allow the firing pin to be propelled by the biasing member to the fire condition to fire the cartridge.

* * * * *